US006843852B2

(12) United States Patent
Dubin et al.

(10) Patent No.: US 6,843,852 B2
(45) Date of Patent: Jan. 18, 2005

(54) APPARATUS AND METHOD FOR ELECTROLESS SPRAY DEPOSITION

(75) Inventors: Valery M. Dubin, Portland, OR (US); Vincent R. Caillouette, Portland, OR (US); Christopher D. Thomas, Aloha, OR (US); Chin-Chang Cheng, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 153 days.

(21) Appl. No.: 10/046,218

(22) Filed: Jan. 16, 2002

(65) Prior Publication Data

US 2003/0134047 A1 Jul. 17, 2003

(51) Int. Cl.[7] ..... B05C 5/02

(52) U.S. Cl. ..... 118/50; 118/52; 118/319; 118/320

(58) Field of Search ..... 118/50, 52, 319, 118/320, 500; 427/240; 205/186, 184, 187, 188, 189, 190, 191, 192, 198; 204/227, 228.2, 228.4, 232, 275.1

(56) References Cited

U.S. PATENT DOCUMENTS 5,695,810 A 12/1997 Dubin ..... 427/96
5,830,805 A 11/1998 Shacham-Diamand ..... 438/678
6,017,437 A * 1/2000 Ting et al. ..... 205/80
6,065,424 A 5/2000 Shacham-Diamand ..... 118/696
6,080,291 A * 6/2000 Woodruff et al. ..... 204/297.01
6,248,168 B1 * 6/2001 Takeshita et al. ..... 118/52
6,248,398 B1 * 6/2001 Talieh et al. ..... 427/240
6,451,114 B1 * 9/2002 Stevens ..... 118/50
2002/0043466 A1 * 4/2002 Dordi et al. ..... 205/123

* cited by examiner

*Primary Examiner*—Laura Edwards
(74) *Attorney, Agent, or Firm*—Jay P. Beale

(57) ABSTRACT

An apparatus for electroless spray deposition of a metal layer on a substrate, e.g., a Co shunt or barrier layer on a Cu layer on a semiconductor wafer, includes a processing chamber to hold the substrate, the processing chamber including at least one section movable between an open position to allow the substrate to be introduced into and removed from the processing chamber and a closed position to seal the processing chamber to allow for pressurization of the processing chamber. The processing chamber has an inlet to provide pressurizing gas, an exhaust line to exhaust pressurizing gas, a pressure regulator to regulate pressure there-within, and a sprayer to spray an electroless plating solution onto the substrate. A method for electroless spray deposition includes providing the in a processing chamber, sealing the processing chamber, pressurizing the processing chamber, regulating the pressure, and spraying an electroless plating solution onto the substrate.

14 Claims, 2 Drawing Sheets

APPARATUS AND METHOD FOR ELECTROLESS SPRAY DEPOSITION

FIELD

The present invention is directed to an apparatus and method for electroless spray deposition. More particularly, the present invention is directed to an apparatus and method for electroless spray deposition of a metal layer on a substrate.

BACKGROUND

In the manufacture of devices on a semiconductor wafer, it is now the practice to fabricate multiple levels of conductive (typically metal) layers above a substrate. One candidate for on chip multilevel interconnections (both wiring and plugs) is copper, since copper has advantages over other metals, e.g., aluminum and tungsten. However, one of the drawbacks of using copper metallization is its fast diffusion in silicon materials, drift in $SiO_2$ dielectric materials, and diffusion into polymers to form agglomerates. Thus, the implementation of a diffusion barrier is highly desirable and necessary in most instances. A variety of materials are known for forming diffusion barriers on copper. Such materials include, Ta, W, Mo, TiW, TiN, TaN, WN, TiSiN and TaSiN, which can be deposited by physical vapor deposition (PVD) or chemical vapor deposition (CVD). Copper can also be passivated and protected from corrosion by silicide formation in dilute silane, by treatment in 1H-benzotriate, and by trimethylaluminum treatment. Furthermore, Ni, Co and Ni—Co alloys can be electrochemically deposited to serve as a diffusion barrier for Cu metallization. For example, U.S. Pat. No. 5,695,810 to Dubin et al. discloses the use of cobalt tungsten phosphide as a barrier material for copper metallization.

One technique for depositing copper and cobalt, as well as other metals, is electroless deposition. Electroless deposition of metal is a process that involves the formation of a thin film of material from an electrolytic solution or fluid without applying an external voltage to the fluid. The depositing of metal results from the electrochemical reaction between the metal ions of the electrolytic solution, reducing agents, and possibly complexing agents and pH adjusters on a catalytic surface (such as may be found on a semiconductor wafer). Electroless deposition is quite suitable for forming barriers and interconnects between the different layers on a wafer.

A common problem in using baths, which is especially true for the electroless deposition process, is that foreign particles or contaminants can be deposited on the substrate surface of the wafer when transferring the wafers from one bath to another bath. Another common problem is the exposure of the substrate surface of the wafer to air during the transfer (from bath to bath) can cause the non-wetting of deep and narrow trenches in the surface or small via (contact) holes in the surface because of electrolyte evaporation. And yet another common problem is that exposure to air may cause oxidation of the catalytic surface that will result in poor catalytic activity and poor quality metal deposits. This problem becomes especially troublesome when using materials that easily oxidize in air such as copper.

There are three basic types of baths: a full immersion bath, a spray bath, or a combination of the two. A full immersion bath completely immerses a semiconductor wafer in a processing fluid when the wafer is within the bath. The spray bath, on the other hand, uses some type of dispersing apparatus, a spray bar for example, to disperse the processing fluid over the wafer when the wafer is within the bath. A combination bath uses a dispersing apparatus to disperse the processing fluid onto the wafer while filling the bath until the wafer is fully immersed by the fluid.

Immersion plating is limited by the requirement to physically lower the wafer into the plating solution, and remove the wafer after plating. Thus, with full immersion baths and, to some extent, with a combination bath, a time delay is necessary between pre-rinse steps and plating and between plating and post-rinse since the electroless reaction continues in a very uncontrolled fashion while the wafer is lifted out of the solution waits to be rinsed. Moreover, electroless deposition with immersion and using a recirculating system, as disclosed in U.S. Pat. Nos. 5,830,805 or 6,065,424 to Shacham-Diamand et al, will have particles generated in the plating bath due to the presence of the reducing agent in the solution. The particles generated in the recirculated electroless plating bath will be deposited on the surface of the wafer, thereby decreasing yield and resulting in line-to-line shorts or leakage.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto. The spirit and scope of the present invention are limited only by the terms of the appended claims.

The following represents brief descriptions of the drawings, wherein.

DETAILED DESCRIPTION

Figure 1:
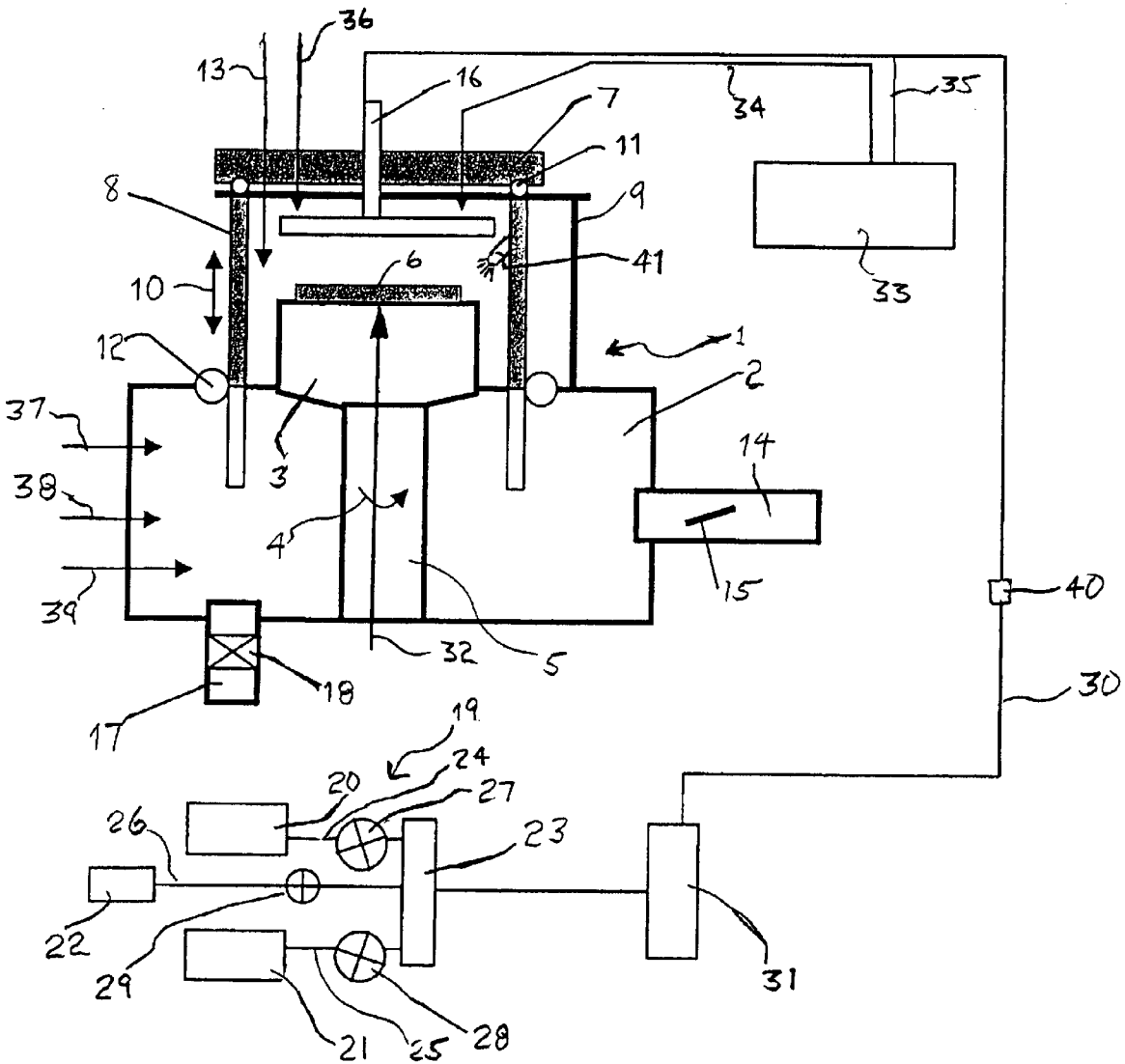
FIG. 1 is a schematic diagram of an example embodiment of the electroless spray deposition apparatus of the present invention.

Before beginning a detailed description of the subject invention, mention of the following is in order. When appropriate, like reference numerals and characters may be used to designate identical, corresponding or similar components in differing figure drawings. Further, in the detailed description to follow, example sizes, models, values, ranges, etc. may be given, although the present invention is not limited to the same. Still further, the figures are not drawn to scale. Further, arrangements may be shown in block or schematic diagram form in order to avoid obscuring the invention, and also in view of the fact that specifics with respect to implementation of such block or schematic diagram arrangements are highly dependent upon the platform within which the present invention is to be implemented, i.e., such specifics should be well within purview of one skilled in the art. Where specific details are set forth in order to describe example embodiments of the invention, it should be apparent to one skilled in the art that the invention can be practiced without, or with variation of, these specific details.

The apparatus of the present invention is useful for electroless spray deposition, e.g., of a metal layer on a substrate. The apparatus includes a processing chamber to hold at least one substrate on which the metal layer is to be deposited, the processing chamber including at least one section movable between an open position to allow the at least one substrate to be introduced into and removed from the processing chamber and a closed position to seal the processing chamber to allow for pressurization of the processing chamber. The processing chamber has an inlet to provide pressurizing gas to the processing chamber, an exhaust line to exhaust pressurizing gas from the processing chamber, and a drain provided in the processing chamber to drain the electroless plating solution from the processing chamber. A pressure regulator is provided to regulate pressure within the processing chamber. A sprayer is provided within the processing chamber to spray an electroless plating solution onto the at least one substrate.

The method of the present invention is also useful for electroless spray deposition of a metal layer on a substrate. The method includes providing at least one substrate on which the metal layer is to be deposited in a processing chamber, sealing the processing chamber in which the at least one substrate is provided, pressurizing the processing chamber, regulating pressure within the processing chamber, and spraying an electroless plating solution onto the at least one substrate.

Referring to the drawings, FIG. 1 is a schematic diagram of an example embodiment of the electroless spray deposition apparatus of the present invention. In the embodiment of FIG. 1, the apparatus includes a processing chamber generally designated by the reference numeral 1. A processing chamber 1 includes a containment bowl 2 on which is mounted a rotatable chuck 3 that can be rotated in the direction of the arrow 4 by rotating shaft 5 on which the chuck 3 is mounted. The chuck 3 holds the substrate 6 on which the metal layer is to be deposited in a manner known in the art. The substrate 6 may be, e.g., a semiconductor wafer having a copper layer provided thereon. In this case, the apparatus can be used to electrolessly spray deposit a barrier layer or shunt film of a cobalt alloy. Of course, the apparatus is useful for depositing other material on other substrates.

In the embodiment of FIG. 1, the processing chamber 1 has a stationary cover 7, which encloses the chamber. In this embodiment, the processing chamber 1 includes sidewalls 8, e.g., in the form of a cylinder which are movable by any known mechanism, schematically illustrated by reference numeral 9, up or down in the directions indicated by the double-headed arrow 10. As can be appreciated, when the processing chamber walls 8 are moved downwardly into an open position, the substrate 6 can be introduced into and removed from the processing chamber by wafer handling equipment known in the art. When the sidewalls 8 are moved upwardly into the closed position illustrated in FIG. 1, the walls seal the processing chamber, e.g., with O-ring 11 to allow for pressurization of the processing chamber 1, as will be described hereinafter.

The moveable walls 8 are sealed with the bowl 2 by, e.g., a bladder or gasket 12. Thus, the interior of the processing chamber 1 in which the substrate 6 is provided is sealed to allow the interior of the processing chamber 1 to be pressurized.

The processing chamber 1 includes an inlet 13 to provide pressurizing gas, e.g., inert gas, e.g., $N_2$, into the processing chamber 1. An exhaust line 14 exhausts the pressurizing gas from the processing chamber 1. A pressure regulator is provided, in this embodiment, the regulator includes a shutter 15 to regulate pressure within the processing chamber.

A sprayer 16 is provided to spray electroless plating solution onto the wafer 6 in a manner known in the art. The sprayer 16 can be, e.g., a spray bar as illustrated in this embodiment, showerhead or other nozzle for delivering electroless plating solution as well as either pre- or post-treating solutions. A drain line 17 for draining the electroless plating solution from the bowl 2 and a valve 18 for controlling the draining are also provided. The valve 18 can be controlled to regulate the pressure in the processing chamber 1. The pressure in the processing chamber 1 can be regulated by controlling the flow rate of pressurizing gas through inlet 13, and controlling the shutter 15 in exhaust line 14 and the valve 18 in drain line 17.

In the embodiment shown in FIG. 1, a point-of-use mixing and distribution system, generally designated by the reference numeral 19, is used to mix and distribute the electroless plating solution. The point-of-use mixing/distribution system 19 including at least a first reservoir 20 to contain a middle stock solution comprising a solution of the metal to be deposited, and a second reservoir to contain a reducing solution. Other reservoirs, e.g., reservoir 22 may be provided to contain deionized water, ultra pure water and other solutions and/or additives. The point-of-use mixing/distribution system 19 includes a mixing chamber 23 for mixing the metal stock solution and the reducing solution to form the electroless plating solution. The first reservoir 20, second reservoir 21 and one or more additional reservoirs are connected to the mixing chamber 23 by respective lines 24, 25, 26. The lines 24, 25 and 26 include respective controllable valves 27, 28, 29 to provide predetermined quantities of the solutions in the respective reservoirs to the mixing chamber 23 at selected times. A supply line 30 connects the mixing chamber 23 to the sprayer 16. An inline heater 31 is provided to heat the electroless plating solution in line 30. Heaters can also be provided to heat the solution in any of the reservoirs 20, 21, 22, mixing chamber 23 or lines 24, 25, 26.

In order to prevent exposure of the back of the substrate 6 to the electroplating solution, a passage 32 is provided through the chuck 3 and shaft 5 through which an inner gas or water can flow onto the back surface of the substrate 6. If desired, the inner gas or water which flows through passage 32 can be heated or cooled to control the temperature of the substrate 6 during plating or pre-treatment or post-treatment.

One or more reservoirs 33 can be provided to contact a pre-treatment solution or water. A pre-treatment solution or water can be used to pre-clean, pre-wet or pre-heat the substrate 6 prior to plating. The one or more reservoirs 33 can also contain a post-treatment solution or water to post-clean the substrate 6. The solution or water within the one or more reservoirs 33 can be delivered to the processing chamber 1 directly through line 34 by any delivery system known in the art or through supply line 30 and sprayer 16 via line 35.

Numerous sensors may be provided. For example, as shown in FIG. 1, the apparatus includes a pressure sensor 36 for detecting the pressure within processing chamber 1, a temperature sensor 37, a level sensor 38 for detecting the level of the electroless plating solution within the bowl 2 and a pH sensor 39 for detecting the pH of the electroless plating solution within bowl 2. A flow sensor 40 can also be provided for sensing the flow rate within supply line 30. One or more nozzles 41 can also be provided for edge bevel cleaning.

Figure 2:
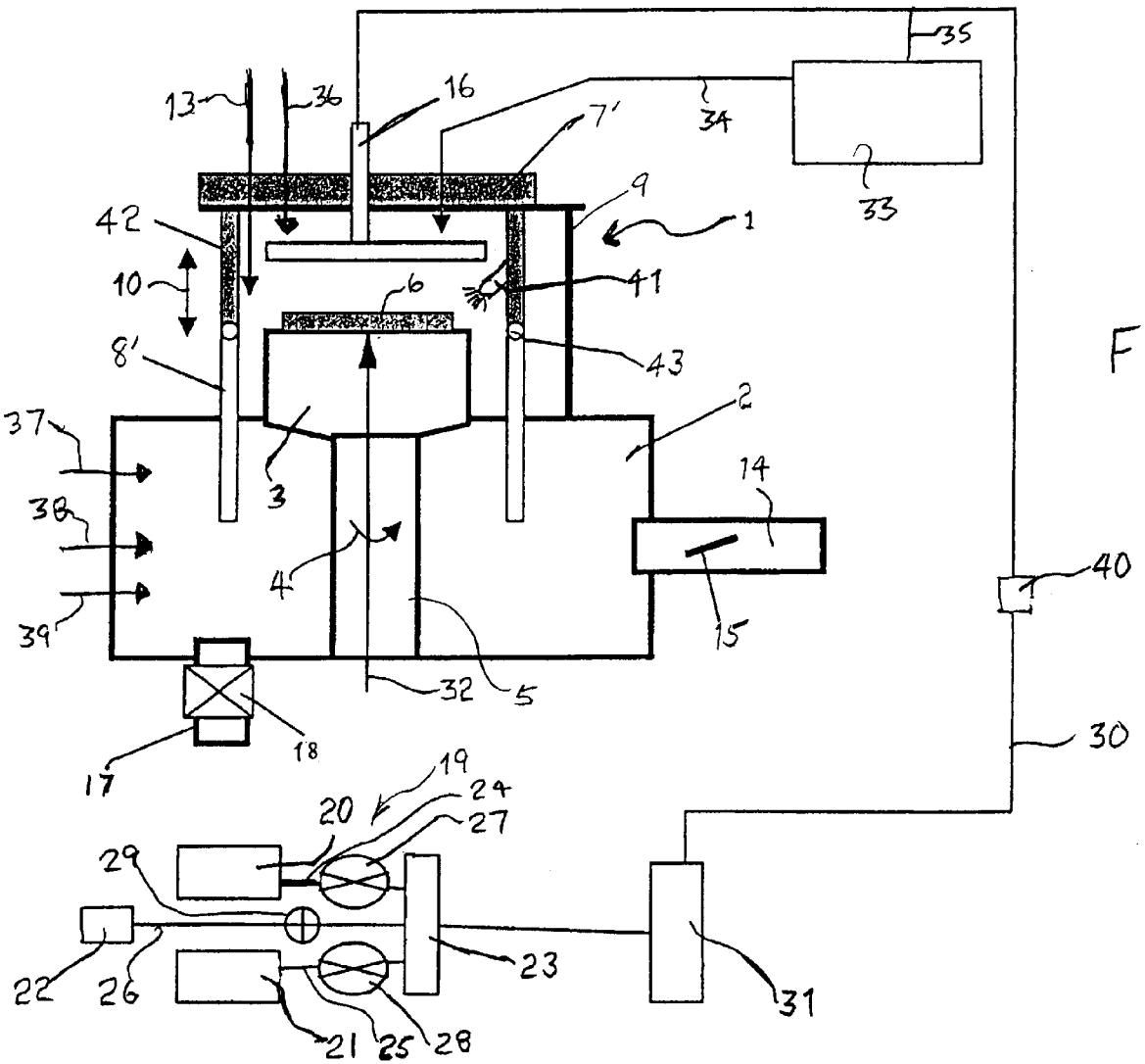
FIG. 2 is a schematic diagram of an example embodiment of the electroless spray deposition apparatus of the present invention.

In the example embodiment as shown in FIG. 2, the lower portion 8' of the cylindrical wall of the processing chamber 1 is stationary. In this embodiment, the cover 7' is movable along with the upper portions 42 of the cylindrical sidewalls. In this example embodiment, the cover 7' and the upper portions of the sidewalls 42 are movable up and down in the directions indicated by the double headed arrow 10 by a mechanism 9. When the cover 7' and upper portions of the sidewalls 42 are moved upwardly by the mechanism 9, the processing chamber 1 is open to allow the substrate 6 to be introduced into and be removed from the processing chamber 1. When the cover 7' and the upper portions of the sidewalls 42 are moved downwardly by the mechanism 9 into the closed position shown in FIG. 2, a processing chamber is sealed, e.g., by O-ring 43 to allow for pressurization of the processing chamber 1.

If the apparatus of the present invention is used to electroless plate a cobalt alloy material as a barrier material or a shunt layer for copper metallization, the present apparatus can be integrated with the copper electroplating tool or the present apparatus can be a stand-alone tool. If used as a stand-alone tool, the present apparatus can include a way for handling equipment, e.g., a robot, software, wafer aligner, front opening unified pod (FOUP), etc., an anneal chamber, and a spin/rinse/dry chamber. The latter can be integrated with an edge-bevel-back clean and optional scrub chamber. The spin/rinse/dry, integrated bevel clean and scrub chamber may be the same chamber as the processing chamber in which the electroless plating is carried out or maybe an additional processing chamber.

The method for electroless spray deposition of a metal layer on a substrate of the present invention will now be described with reference to the following example embodiments in which a description is given of forming a cobalt barrier or shunt layer on copper metallization lines. However, the method of the present invention is not limited to a formation of cobalt barrier or shunt layers on copper metallization lines but is useful to electrolessly spray deposit other layers on other substrates.

According to the example embodiments, the processing chamber is opened by lowering the cylindrical sidewalls 8 in the example embodiment in FIG. 1 or by raising the cover 7' on the upper portions 42 of the sidewalls with mechanism 9 in the example embodiment shown in FIG. 2. A semiconductor wafer 6 having copper metallization lines thereon is then provided on rotatable chuck 3. The processing chamber is then closed using mechanism 9. The wafer 6 may then be pre-cleaned or pre-wet before the electroless metal plating begins. The pre-clean or pre-wetting can be accomplished by $H_2O$ (hot or room temperature) or by a solution containing chemicals to dissolve surface oxides and surface contaminations; such chemicals includes acids such as $H_2SO_4$, various sulfonic acids, including methanesulfonic acid (MSA), ethanesulfonic acid (ESA), propanesulfonic acid (PSA) and benzene sulfonic acid (BSA), HF, $HNO_3$, citric acid, acetic acid, malonic acid, and tartaric acid, bases (tetramethyl ammonium hydroxide (TMAH), $NH_4OH$, etc.) or combinations of acids and bases with oxidizers such as $H_2O_2$, persulfate, etc. Pre-wetting may also be accomplished by wetting agents such as polyethylene glycol (PEG), polypropylene glycol (PPG), 1-propane sulfonic acid, 3,3'-dithio-dis, di-sodium salt (SPS), RE610, and saccharin and/or reducing agents such as dimethylaminoforaue (DMAB) and/or sodium forohydride.

To enable plating on hydrophobic surfaces, the substrate may be pre-wet with water-based solutions containing wetting agents or surfactants such as PEG and PPG and/or pre-wet with non-aqueous liquids such as methanol, ethanol, isopropanol, etc.

If it is desired to preheat the substrate prior to electroless plating, the pre-wetting solutions can be heated.

If it is necessary to pre-catalyze the surface to be plated, the pre-wetting solution may contain a catalyzing agent such as DMAB (by itself or in addition to cleaning agents, surfactants and/or bases such as TMAH, $NH_4OH$, etc.).

To begin electroless plating, the processing chamber 1 is sealed, and the drain 17 and shutter 15 closed. Flowing inert gas into the chamber then pressurizes the processing chamber 1. The pressure is regulated by using the shutter 15 in the exhaust line 14 to control the pressure to a pressure appropriate for the particular plating operation. The pressure is chosen to reduce evaporation of the plating solution from the surface of the wafer 6. One skilled in the art can determine the appropriate pressure for the particular plating operation.

The plating solution, described with more particularity hereinafter, is sprayed onto the substrate 6 through sprayer 16 while the wafer 6 is rotated on chuck 3 by rotating shaft 5 in the direction of arrow 4. Rotation of the wafer 6 improves the uniformity of surface coverage of the plating solution on the wafer 6.

After plating, the processing chamber 1 is depressurized by opening the shutter 15 and/or drain valve 18. The wafer 6 is then rinsed, e.g., with ultrapure water. Optionally, the front surface of the wafer 6 may be cleaned after plating with deionized water and/or cleaning agents such as dilute HF, dilute $H_2SO_4$, dilute HCl, citric acid, acetic acid, MSA, BSA, $NH_4OH$, $HNO_3$, etc. This can be done in the processing chamber 1 or in a separate chamber. Optionally, the wafer 6 may be scrubbed w/$H_2O$ or cleaning agents to improve line-to-line leakage. This can also be done in the processing chamber 1 or in the separate chamber. Optionally, the wafer 6 can be treated to clean edge, bevel, and backside of the wafer 6 with cleaning chemicals including acids, bases and oxidizers ($H_2O_2$, ammonium persulfate, $HNO_3$, $H_2SO_4$, etc). This can also be done in the processing chamber 1 or in the separate chamber.

The wafer 6 is then dried with inert gas (heated or non-heated) and optionally the electrolessly deposited layer annealed to improve adhesion and facilitate $H_2$ evolution from the film.

As stated above, the apparatus and method of the present invention may be used to deposit a Co shunt layer selectivity on post-CMP Cu lines as well as to deposit a Co barrier on PVD/CVD Co seed or other catalytic metal seeds (or their mixtures) including but not limited to Ni, Au, Ag, Cu, Rh, Ru etc. The Co barrier material can be, e.g., CoWP, CoWBP, CoWB, etc.

To electrolessly deposit a CoPB barrier layer, the following process can be used:

Co Shunt Chemistry:

A. Stock solution:

$CoCl_2(H_2O)_6$ 30 g/L $NH_4Cl$ 50 g/L

Citric acid 57 g/L

B. Adjust pH with TMAH

C. Add ammonium hypophosphite, 2 g/L of stock in A

D. Add DMAB, 20 g/L of stock in A

E. Add desired organic additives such as RE61O, saccharin etc

F. Operating parameters:

T=40–60° C.

pH=8–10

G. Post plating clean with 5% $H_2SO_4$ for 5 sec. with wafer rotation followed by standard SRD rinse.

To electrolessly deposit a CoWB barrier layer, the following process can be used:

A. Stock solution:

$CoCl_2(H_2O)_6$ 30 g/L $(NH_4)_2WO_4$ 10 g/L $Na_3C_6H_4O_7(H_2O)_2$ 80 g/L (sodium citrate dihydrate or citric acid))

B. Adjust pH with TMAH

C. Add reducing agent (selection depends on species desired in deposit):

P: Ammonium hypophosphite 20 g/L

B: DMAB 20 g/L

D. Add 0.05 g/L of RE61O (or SPS, saccharin etc)

F. Operating condition:

T=60° C. (55–90° C. in literature)

pH 9.5 (8.5–10.5 in literature)

G. A post plating clean with 5% $H_2SO_4$ for 5 sec. with wafer rotation followed by standard SRD rinse.

The present invention provides the following advantages. The method and apparatus enables the selective electroless deposition of a metal layer, e.g., a Co shunt or barrier layer in a short deposition time and enables spray deposition with small chemical consumption (<100 ml/wafer pass). An advantage of the plating chemistry described herein is the ability to plate selectively on Cu, thereby eliminating the activation step with Pd. The method and apparatus of the present invention allows spray deposition in a controlled pressurized environment to reduce evaporation of volatile compounds used in the plating bath (such as TMAH, $NH_4OH$ etc). This is accomplished by regulating the pressure by using the valve in the drain line and the shutter in the exhaust line.

The electroless spray deposition apparatus and method of the present invention has advantages over immersion deposition since it allows point-of-use chemical blending with no solution decomposition. On the other hand, electroless Co deposition with immersion and a recirculation system will have particles generated in the plating bath due to the presence of the reducing agent in the solution. Therefore, a low defect count cannot be obtained in the immersion deposition method. The particles generated in immersion-recirculated electroless plating bath will be deposited on the surface of the wafer, thereby decreasing yield and resulting in line-to-line shorts and/or leakage.

Immersion plating is limited by the requirement to physically lower the wafer into the plating solution, and remove the wafer after plating. Thus, with full immersion bathes and, to some extent, with a combination bath, a time delay is necessary between pre-rinse steps and plating and between plating and post-rinse since the electroless reaction continues in a very uncontrolled fashion while the wafer is lifted out of the solution waits to be rinsed. On the other hand, the present invention enables no delay between wafer preparation (cleaning, pre-wetting and heating) and electroless plating. Also, the present invention allows very precise control of the exposure time of reactants on the wafer by enabling the immediate dispensing of cold rinsing and/or post-cleaning fluids onto the wafer surface after the desired plating time.

The electroless spray deposition apparatus and method of the present invention also allows point of use mixing, as well as disposal of plating solution after deposition, thereby eliminating the need for plating bath maintenance, such as the control (bath metrology) and replenishment of consumed components.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or method steps within the scope of the foregoing disclosure, the drawings and the appended claims without departing from the spirit of the invention. In addition to variations and modifications in the component parts and/or method steps, alternative uses will also be apparent to those skilled in the art.

What is claimed is:

1. An apparatus for electroless spray deposition of a metal layer on a substrate, comprising:

a processing chamber to hold at least one substrate on which the metal layer is to be deposited, the processing chamber including at least one section movable between an open position to allow the at least one substrate to be introduced into and removed from the processing chamber and a closed position to seal the processing chamber to allow for pressurization of the processing chamber;

an inlet to provide pressurizing gas to the processing chamber;

an exhaust line to exhaust pressurizing gas from the processing chamber;

a source of electroless plating solution;

a sprayer provided within the processing chamber and connected to the source of electroless plating solution to spray the electroless plating solution onto the at least one substrate;

a drain provided in the processing chamber to drain the electroless plating solution from the processing chamber; and a pressure regulator within the processing chamber to regulate pressure within the processing chamber, the pressure regulator including a shutter provided in the exhaust line and a valve provided in the drain.

2. The apparatus according to claim 1, wherein the processing chamber includes a chamber body and a stationary cover and wherein the chamber body is movable between the open position and the closed position.

3. The apparatus according to claim 2, wherein the chamber body has a cylindrical shape and, in the closed position, the chamber body is sealed to the stationary cover by an o-ring.

4. The apparatus according to claim 1, wherein the processing chamber includes a chamber body and a cover and wherein the cover is movable between the open position and the closed position.

5. The apparatus according to claim 4, wherein the chamber body has a cylindrical shape and, in the closed position, the cover is sealed to the chamber body by an o-ring.

6. The apparatus according to claim 1, wherein the sprayer is a spray bar.

7. The apparatus according to claim 1, further comprising a first reservoir to contain a metal stock solution comprising a solution of the metal to be deposited; a second reservoir to contain a reducing solution; the metal stock solution and reducing solution, when mixed in predetermined proportions forming the electroless plating solution; a mixing chamber for mixing the metal stock solution and the reducing solution to thereby provide the electroless plating solution; first and second lines including respective first and second controllable valves to provide predetermined quantities of the solutions in the respective reservoirs to the mixing chamber at selected times; and a supply line connecting the mixing chamber and the sprayer so as to follow for delivery of said electroless plating solution to the sprayer.

8. The apparatus according to claim 7, further comprising a heater to heat solution in at least one of the first reservoir; the second reservoir, the mixing chamber, the first and second lines and the supply line.

9. The apparatus according to claim 7, further comprising at least one additional reservoir to contain at least one fluid selected from the group consisting of a pre-cleaning fluid, a pre-wetting fluid, ultra-pure water, deionized water, and a post-cleaning fluid.

10. The apparatus according to claim 1, further comprising a source of inert gas, wherein the pressurizing gas comprises the inert gas and the inlet to provide pressurizing gas is connected to the source of inert gas.

11. An apparatus for electroless spray deposition of a metal layer on a substrate, comprising:

a processing chamber to hold at least one substrate on which the metal layer is to be deposited, the processing chamber including at least one section movable between an open position to allow the at least one substrate to be introduced into and removed from the processing chamber and a closed position to seal the processing chamber to allow for pressurization of the processing chamber;

means for pressurizing the processing chamber;

means for regulating pressure within the processing chamber, the means for regulating pressure including a shutter provided in an exhaust line of the chamber and a valve provided in a drain of the chamber; and means for spraying an electroless plating solution onto the at least one substrate.

12. The apparatus according to claim 11, further comprising means for heating the electroless plating solution.

13. The apparatus according to claim 11, wherein the means for pressurizing the processing chamber includes means for introducing inert gas into the processing chamber.

14. An apparatus for electroless spray deposition of a metal layer on a substrate, comprising:

a processing chamber to hold at least one substrate on which the metal layer is to be deposited, the processing chamber including at least one section movable between an open position to allow the at least one substrate to be introduced into and removed from the processing chamber and a closed position to seal the processing chamber to allow for pressurization of the processing chamber;

an inlet to provide pressurizing gas to the processing chamber;

an exhaust line to exhaust pressurizing gas from the processing chamber;

a pressure regulator to regulate pressure within the processing chamber;

a source of electroless plating solution;

a sprayer provided within the processing chamber and connected to the source of electroless plating solution to spray the electroless plating solution onto the at least one substrate;

a drain provided in the processing chamber to drain the electroless plating solution from the processing chamber; and a rotatable chuck provided within the processing chamber, the rotatable chuck having a passage formed therein to allow fluid to flow to the back of a substrate positioned on the chuck.

* * * * *